US011512701B2

(12) United States Patent
Wang

(10) Patent No.: US 11,512,701 B2
(45) Date of Patent: Nov. 29, 2022

(54) CUTTING SYSTEM FOR A GRINDING PUMP AND RELATED GRINDING PUMP

(71) Applicant: Chengli Li, Suzhou (CN)

(72) Inventor: Shengyan Wang, Suzhou (CN)

(73) Assignee: Chengli Li, Suzhou (CN)

( * ) Notice: Subject to any disclaimer, the term of this patent is extended or adjusted under 35 U.S.C. 154(b) by 80 days.

(21) Appl. No.: 17/098,850

(22) Filed: Nov. 16, 2020

(65) Prior Publication Data

US 2022/0145890 A1 May 12, 2022

(30) Foreign Application Priority Data

Nov. 10, 2020 (CN) ..... 202011243635.6
Nov. 10, 2020 (CN) ..... 202022574986.7

(51) Int. Cl.
*F04D 7/04* (2006.01)
*B02C 18/18* (2006.01)
*B02C 18/10* (2006.01)

(52) U.S. Cl.
CPC ..... *F04D 7/045* (2013.01); *B02C 18/10* (2013.01); *B02C 18/182* (2013.01); *B02C 2018/188* (2013.01)

(58) Field of Classification Search
CPC ..... F04D 7/045; B02C 18/10; B02C 18/182; B02C 2018/188
USPC ..... 415/121.1
See application file for complete search history.

(56) References Cited

U.S. PATENT DOCUMENTS 2,658,453 A * 11/1953 Walters ..... F04D 1/006 415/121.2
3,973,866 A * 8/1976 Vaughan ..... F04D 7/045 241/46.11
4,108,386 A * 8/1978 Conery ..... B02C 18/0092 241/46.11
4,141,510 A * 2/1979 Smith ..... B02C 18/0092 241/185.6
4,448,359 A * 5/1984 Meyers ..... A47L 15/4227 241/257.1
4,454,993 A * 6/1984 Shibata ..... B02C 18/0092 241/46.11

(Continued)

FOREIGN PATENT DOCUMENTS

DE 3670920 A1 * 6/2020 ..... F04D 7/045

*Primary Examiner* — Hung Q Nguyen
*Assistant Examiner* — Anthony Donald Taylor, Jr.
(74) *Attorney, Agent, or Firm* — Chen Yoshimura LLP

(57) ABSTRACT

A cutting system for a grinding pump, including a cutting disc attached to the pump near an inlet and having a cutting surface with multiple cutting orifices, and a rotating cutter attached to the rotating shaft of the pump and having two cutting blades, each blade having a cutting edge on a forward-facing side of the rotating cutter. The rotating cutter is located on the upstream side of the cutting disc, and cooperates with the cutting orifices of the cutting disc to perform cutting actions. Each cutting orifice has a hole extending from the cutting surface through the cutting disc to form a feeding orifice, and a cutting protrusion protruding from the cutting surface and surrounding the hole region. The multiple cutting orifices define recessed areas of the cutting surface between the cutting orifices. The cutting system can prevent uncut floating matters from being trapped, and is effective and safe.

12 Claims, 5 Drawing Sheets

(56) References Cited

U.S. PATENT DOCUMENTS 4,527,947 A * 7/1985 Elliott ..... F04D 7/045 415/121.2
4,778,336 A * 10/1988 Husain ..... F04D 7/045 241/46.06
5,016,825 A * 5/1991 Carpenter ..... F04D 7/045 241/46.06
5,256,032 A * 10/1993 Dorsch ..... F04D 7/045 415/121.1
5,450,777 A * 9/1995 Molnar ..... D01G 1/04 226/110
5,456,580 A * 10/1995 Dorsch ..... B02C 18/0092 415/121.1
5,460,482 A * 10/1995 Dorsch ..... F04D 7/045 415/121.1
6,241,470 B1 * 6/2001 Oakley ..... F04D 7/045 415/206
7,080,797 B2 * 7/2006 Doering ..... F04D 7/045 241/185.6
7,118,327 B2 * 10/2006 Doering ..... F04D 7/045 415/121.2
7,159,806 B1 * 1/2007 Ritsema ..... F04D 3/02 241/89.4
7,237,736 B1 * 7/2007 Martin ..... F04D 7/045 241/46.06
8,105,017 B2 * 1/2012 Dorsch ..... F04D 29/2288 416/185
8,562,287 B2 * 10/2013 Schmidt ..... E03F 5/22 415/121.1
8,657,564 B2 * 2/2014 Cuppetelli ..... F04D 29/2288 415/121.1
8,905,341 B2 * 12/2014 Dorsch ..... F04D 7/045 241/46.06
9,371,834 B2 * 6/2016 Daugaard ..... F04D 29/2288
10,054,136 B2 * 8/2018 Sowa ..... B02C 18/0092
2013/0108411 A1 * 5/2013 Ciotola ..... F04D 7/045 83/592
2014/0199165 A1 * 7/2014 Pohler ..... F04D 1/00 415/204
2016/0363123 A1 * 12/2016 Davis ..... F04D 29/4293
2017/0306965 A1 * 10/2017 Bevington ..... F04D 7/045
2018/0202453 A1 * 7/2018 Pohler ..... B02C 18/0092
2020/0353475 A1 * 11/2020 Brinkmann ..... F04D 7/045
2022/0001388 A1 * 1/2022 Neer ..... B02C 18/18

* cited by examiner

CUTTING SYSTEM FOR A GRINDING PUMP AND RELATED GRINDING PUMP

BACKGROUND OF THE INVENTION

Field of the Invention

This invention relates to grinding pumps, and in particular, it relates to a cutting system for grinding pumps.

Description of Related Art

For a pump used to pump or transport a liquid or slurry containing solid or semi-solid matters, a cutting device is often provided on the inlet side of the pump, to cut the solid matters suspending in the liquid into smaller pieces, so that they can pass the pump more easily. Such pumps are often referred to as grinding pumps or chopping pumps. Typically, a cutting system of a grinding pump includes cutting blades, a rotating shaft, and a cutting disc. The cutting blades have cutting edges; the cutting disc has a cutting surface, which has a series of orifices with cutting edges. In operation, the cutting blades rotate with the rotating shaft and cooperate with the orifices of the cutting disc to accomplish cutting. The cutting edges of the cutting blades are on a plane, and the cutting edges of the cutting disc are on a plane; these two planes are designed to be on a common plane. However, floating matters in the liquid being transported by the pump, such as solid or semi-solid particulates, fabric or fibrous matters, etc., can become lodged and stuck in gaps between the cutting blades and the cutting disc. Once stuck, they are very difficult to be released. This may interfere with the rotation of the rotating shaft or even cause the rotating shaft to be stuck, which can cause the electric motor to be overloaded or even stall. Moreover, when the floating matters are not cut into desired smaller pieces, they can impede the transport of the floating matters in the liquid, causing the impeller or the cutting blades to be stuck. These concerns place high requirements on the precision of installation and improved structural design of the cutting device of grinding pumps.

SUMMARY

Accordingly, the present invention is directed to a cutting system for a grinding pump with improvements aimed at solving various problems of the conventional technology. The cutting system can effectively cut the floating matters in the liquid and discharge them from the pump, with increased cutting effectively and efficiency.

In one aspect, the present invention provides a cutting system for a grinding pump, where the cutting system includes: a cutting disc, configured to be attached to the grinding pump near an inlet of the grinding pump, wherein the cutting disc includes a cutting surface, and the cutting surface has a plurality of cutting orifices; and a rotating cutter, configured to be attached to the grinding pump via a rotating shaft of the grinding pump, wherein the rotating cutter includes at least two cutting blades, each cutting blade having a cutting edge on a forward-facing side in a direction of rotation of the rotating cutter, the rotating cutter being located on an upstream side of the cutting disc, wherein the cutting edge is configured to cooperate with the cutting orifices of the cutting disc to perform cutting actions when the rotating cutter rotates; wherein each cutting orifice of the cutting disc has a hole region extending from the cutting surface through the cutting disc to form a feeding orifice, and has a cutting protrusion that protrudes from the cutting surface, the cutting protrusion surrounding the hole region, wherein the plurality of cutting orifices define recessed areas of the cutting surface between the cutting orifices.

In the cutting system, by improving the structure of the cutting orifices to form the recessed areas between the cutting orifices, the recessed areas provide axial gaps between the rotating cutter and the cutting disc. Thus, except at the cutting orifices, the cutting disc and rotating cutter do not have opposing surfaces with very small gaps. As a result, the cutting action at the interface of the cutting disc and rotating cutter ensures that the floating matters are effectively cut and discharged.

Based on the above principles, embodiments of the present invention may have one or more of the following features.

In some embodiments, the cutting orifices are arranged on the cutting disc in a radial direction and distributed in a circumferential direction with respect to a rotation axis of the rotating shaft.

In some embodiments, the cutting protrusion of each cutting orifice is a ring shaped structure and includes an inner cutting edge on an inner side of the ring shaped structure and an outer cutting edge on an outer side of the ring shaped structure. By providing the dual inner and outer cutting edges, the floating matters entering the cutting orifices from the cutting protrusions can be effectively cut, making the cutting system more effective.

In some embodiments, the ring shaped structure of the cutting protrusion has at least one gap; in some other embodiments, the ring shaped structure is a closed ring without any gaps.

In some embodiments, the cutting disc includes a plurality of cutting groups, each cutting group including at least two of the plurality of cutting orifices, and wherein the plurality of cutting groups are arranged on the cutting disc in a radial direction and distributed in a circumferential direction with respect to a rotation axis of the rotating shaft.

In some embodiments, at least one cutting group further includes at least one cutting tip, configured to connect the two cutting orifices of the cutting group, the cutting tip having a cutting tip edge connected to the cutting edges of the cutting orifices.

In some embodiments, the cutting tip edge face against a forward moving direction of the rotating cutter.

In some embodiments, the cutting disc further includes a plurality of cutting blocks distributed between the cutting orifices, wherein each cutting block has a cutting edge facing against a forward moving direction of the rotating cutter.

In some embodiments, the cutting surface of the cutting disc further includes a plurality of diversion ribs, which are either connected to or separated from the cutting orifices, wherein the diversion ribs are protrusions from the cutting surface and are distributed in a circumferential direction around a rotation axis of the rotating shaft.

In some embodiments, each diversion rib has a curved or a linear shape and extends in a radial direction of the cutting disc, and wherein when the diversion rib has a curved shape, a tangential direction of the curved shape is parallel to a moving direction of the cutting edge of the rotating cutter.

In some embodiments, the recessed areas are located on at least one plane.

In another aspect, the present invention provides a grinding pump, which includes a pump body having the inlet and an outlet, and rotating shaft disposed within the pump body, and further includes the above cutting system, wherein the cutting disc of the cutting system is fixedly connected to the pump body and covers the inlet, wherein the rotating cutter of the cutting system is fixedly connected to the rotating shaft and is driven by the rotating shaft to rotate, so that the cutting edges of the rotating cutter cooperate with the cutting orifices of the cutting disc to performing cutting actions.

The cutting system according to embodiments of the present invention can effectively reduce the sizes of the floating matters, and can prevent uncut or insufficiently floating matters from being trapped. This prevents the impeller and rotating cutter from being stuck, and improves the effectiveness and safety of the pump. The grinding pump according to embodiments of the present invention has low cost, is easy to manufacture, and has a long service life.

BRIEF DESCRIPTION OF THE DRAWINGS

Preferred embodiments of the present invention are described with reference to the drawings. In these drawings, like reference symbols represent like features.

DETAILED DESCRIPTION OF PREFERRED EMBODIMENTS

Preferred embodiments of the present and their applications are described below. It should be understood that these descriptions describe embodiments of the present invention but do not limit the scope of the invention. When describing the various components, directional terms such as "up," "down," "top," "bottom" etc. are not absolute but are relative. These terms may correspond to the views in the various illustrations, and can change when the views or the relative positions of the components change.

Figure 1:
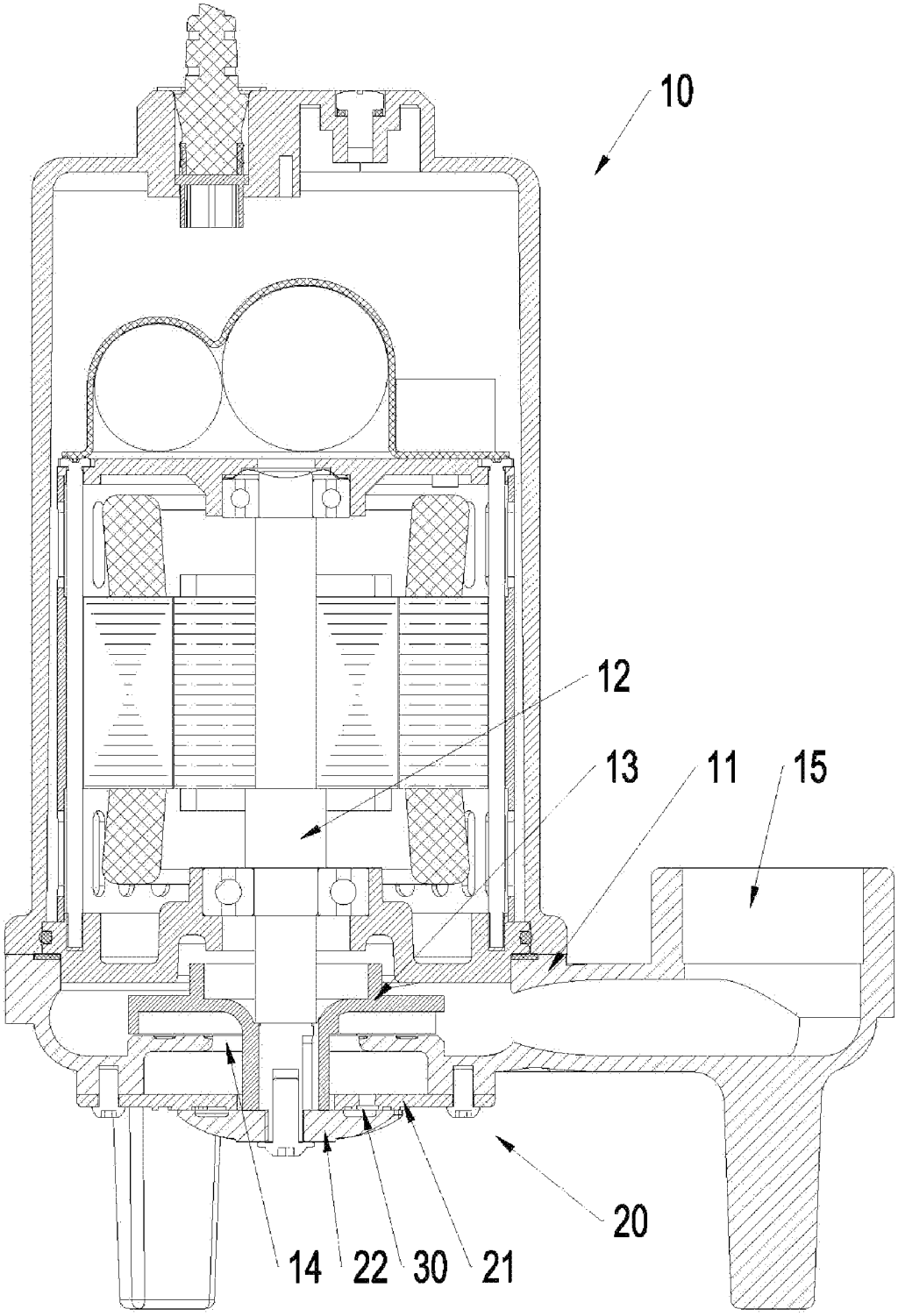
FIG. 1 is a cross-sectional view showing a grinding pump according to an embodiment of the present invention.

In this disclosure, terms such as "connect", "couple", "link" etc. should be understood broadly; for example, they may be fixed connections, or removable or detachable connections, or integrally connected or integrally formed; they may be directly connected, or indirectly connected via intermediate parts. Those skilled in the relevant art can readily understand the meaning of these terms as used in this disclosure based on the specific description and context. Referring to FIG. 1, the grinding pump 10 includes a pump body 11 having an inlet 14 and an outlet 15. A rotating shaft 12 is disposed within the pump body 11. An impeller 13 is disposed within a chamber defined by the pump body 11, and is supported by and driven to rotate by the rotating shaft 12, so that a liquid is transported from the inlet 14 on the suction side or upstream side to the outlet 15 on the discharge side or downstream side. Typically, a cutting system 20 of the grinding pump 10 is disposed at or near the inlet 14, and includes a cutting disc 21 and a rotating cutter 22 that cooperate with each other. The cutting disc 21 is fixedly connected to the pump body 11, for example, by threaded fasteners, and covers the inlet 14. The cutting disc 21 has a number of cutting orifices 30, which serve as feeding orifices with a filtering function. The rotating cutter 22 is fixedly connected, for example, by threaded fasteners, to the rotating shaft 12 on the upstream side of the cutting disc 21. Thus, the rotating cutter 22 rotates with the rotating shaft 12 and cooperates with the cutting disc 21 to cut the floating matters that enters the feeding orifices, to reduce the sizes of the floating matters in the liquid (e.g. wastewater) so that they can readily enter the pump.

It should be understood that while the descriptions below use a pump for wastewater as an example of a grinding pump, the grinding pump may also be, without limitation, any water pump, vacuum cleaner, suction filter, etc. that has a cutting function.

According to embodiments of the present invention, gaps in the axial direction (the direction parallel to the rotating shaft) is provided between the cutting disc and the rotating cutter of the cutting system, which can allow the floating matters to be sufficiently cut so they can smoothly enter the pump body. Such axial gaps can be realized without requiring additional components, and do not adversely affect the normal cutting operation.

Figure 2:
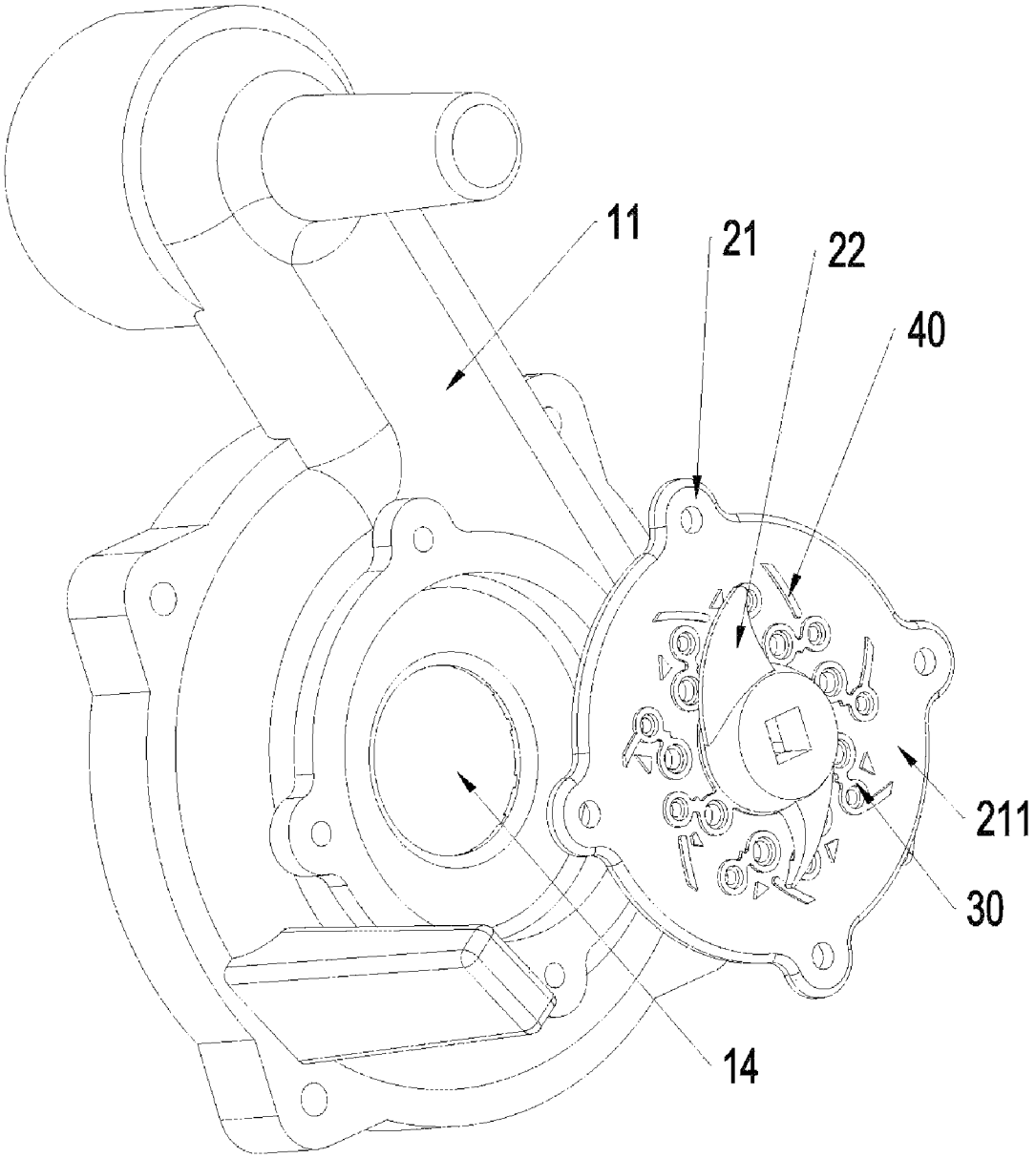
FIG. 2 is a exploded view of a cutting system for a grinding pump according to an embodiment of the present invention.
Figure 3:
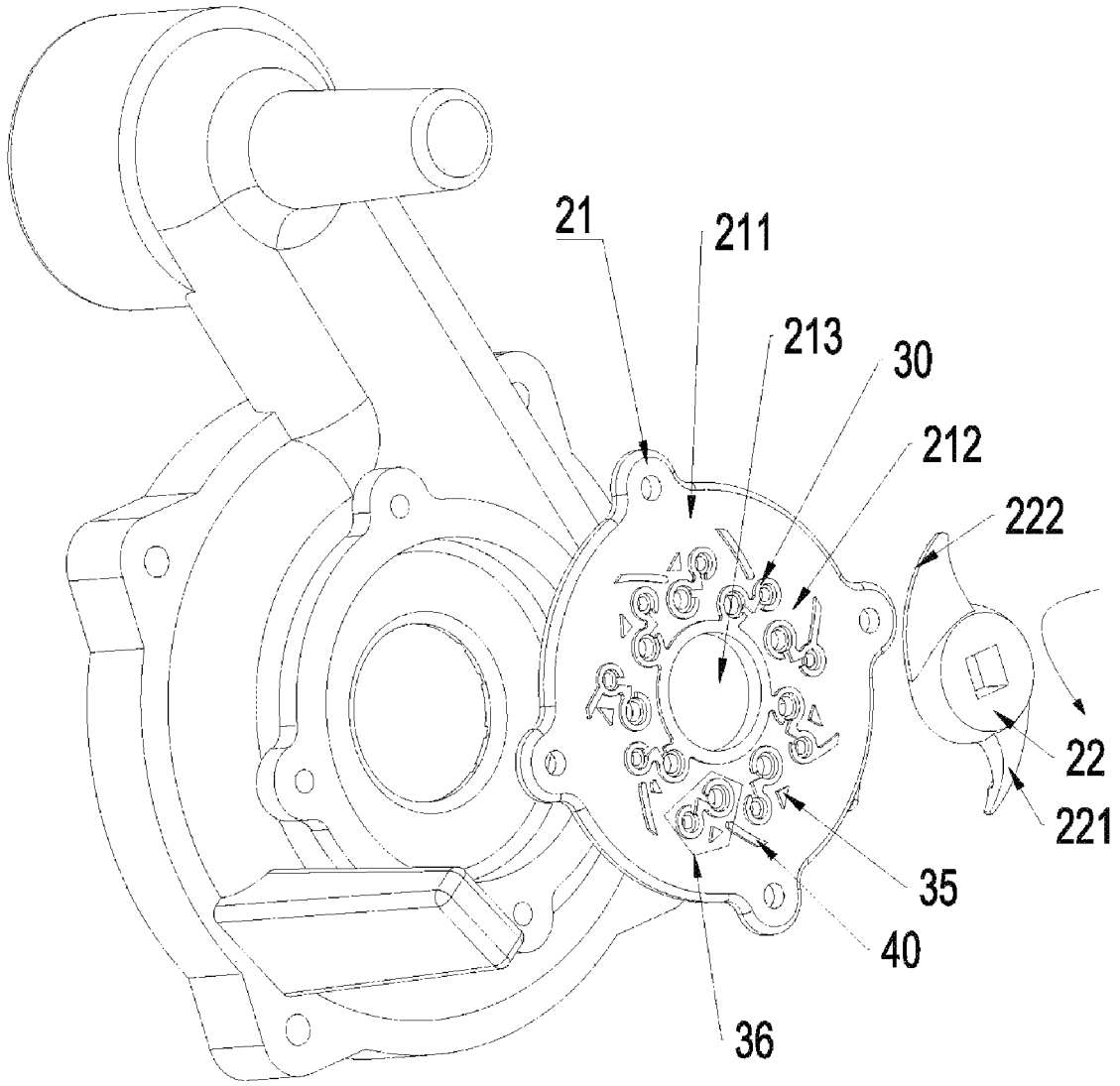
FIG. 3 is another exploded view of the cutting system shown in FIG. 2.

More specifically, referring to FIGS. 2 and 3, the cutting system according to an embodiment of the present invention includes a cutting disc 21 and a rotating cutter 22. The cutting disc 21 is adapted to be affixed to the pump body 11 near the inlet 14, and has a cutting surface 211. The cutting surface 211 has a series of cutting orifices 30 with cutting edges. The rotating cutter 22 is adapted to be affixed to the rotating shaft 12 (not shown in FIGS. 2 and 3) of the grinding pump, which extends through a central opening 213 of the cutting disc 21, so as to be rotationally coupled to the grinding pump 10. The rotating cutter 22 has at least two cutting blades 221 that extend in a substantially radial direction of the rotation axis. The illustrated embodiment shows two cutting blades, but there may be three, four, or other number of cutting blades. Each cutting blades 221 has a cutting edge 222 on the forward-facing side in the direction of rotation (counter-clockwise in this example, as shown by the arrow in FIG. 3). When the rotating cutter 22 is driven by the rotating shaft 12 to rotate, the cutting edges 222 cooperate with the cutting orifices 30 of the cutting disc 21 to cut the floating matters.

Figure 4A:
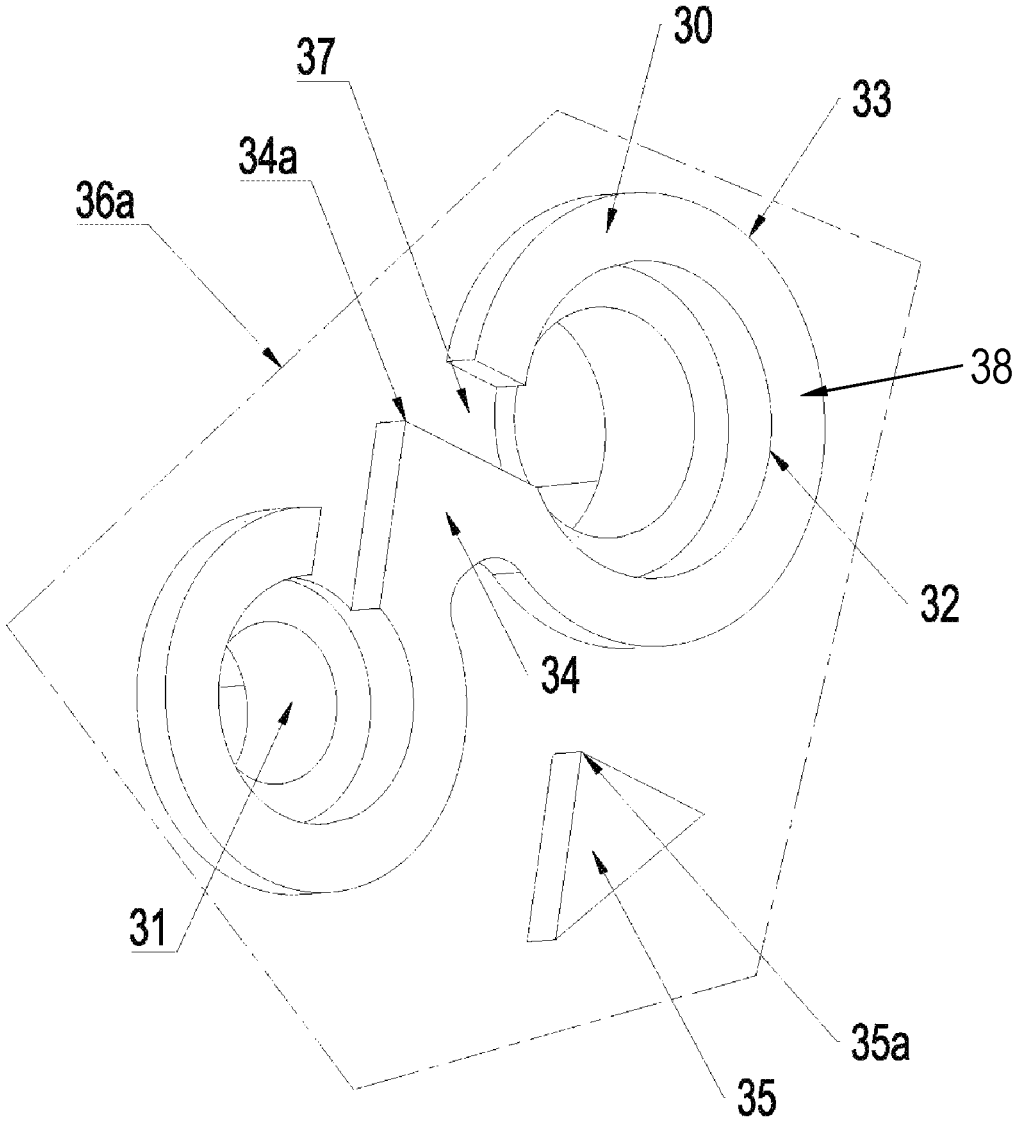
FIG. 4*a* shows an exemplary cutting group of the cutting disc of FIG. 3 according to one embodiment of the present invention.
Figure 4B:
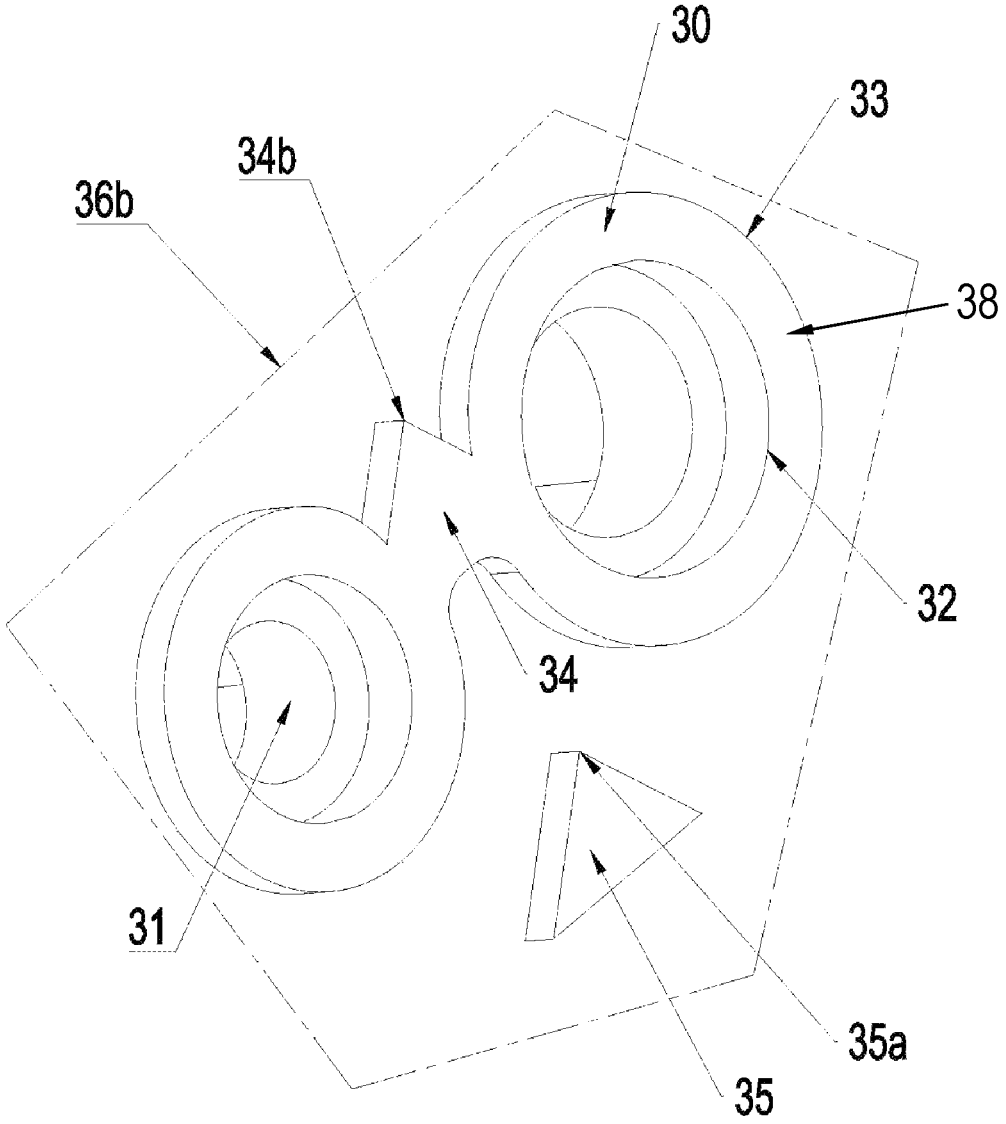
FIG. 4*b* shows an exemplary cutting group of the cutting disc of FIG. 3 according to another embodiment of the present invention.

Referring to FIGS. 4*a* and 4*b*, in some embodiments, each cutting orifice 30 of the cutting disc 21 includes a hole region 31 extending from the cutting surface 211 through the cutting disc 21, to form a feeding orifice. In some embodiments, the cross-sectional size of the hole region 31 is constant in the axial direction of the hole, or the size may increase or decrease in the feeding direction of the materials. Also, while the hole regions 31 shown in the drawings have a round cross-section, they may alternatively have any other suitable cross-sectional shapes, such as oval, triangular, square, rectangular, regular or non-regular polygons, etc. In various embodiments, the multiple cutting orifices 30 may have the same or different sizes, and the same or different cross-sectional shapes.

Each cutting orifice 30 beneficially includes a cutting protrusion 38 that protrudes from the cutting surface 211 and surrounds the hole region 31. Correspondingly, the areas of the cutting surface 211 not occupied by the cutting orifices 30 (the cutting protrusions 38) constitute recessed areas 212 which are recessed as compared to the protruded surface of the cutting protrusions 38, as shown in FIG. 3. Preferably, all cutting protrusions 38 protrude by the same distance and have flat top surfaces. Depending on nature of the liquid being transported and the floating matters in the liquid, the protruding distance of the cutting protrusions 38 from the cutting surface 211 may be chosen based on practical need. This defines the recessed depth of the recessed areas 212 (i.e., the axial gap). The axial position of the cutting edges 222 of the rotating cutter 22 is adjusted to be at the same plane as the top surfaces of the cutting protrusions 38. Preferably, the recessed areas 212 are on the same plane. In some alternative embodiments, the axial gap between the top surface of the cutting protrusions 38 and the cutting surface 211 may have different values, forming multiple levels of recessed regions, which can provide a multi-level cutting effect.

In these embodiments, during operation, the recessed areas 212 provide a space for the floating matters to move around near the cutting surfaces, so that they will not become stuck between the rotating cutter 22 and the cutting disc 21 and will not cause the rotating cutter 22 or rotating shaft 12 to be stuck. This can ensure successful transportation of the floating matters. Because the recessed areas 212 are present only between the different cutting orifices 30, they will not adversely affect the cutting operation of the cutting orifices 30 and rotating cutter 22, so that the floating matters can be successfully cut.

In some embodiments, the multiple cutting orifices 30 are independent of each other and are arranged on the cutting disc 21 in the radial direction and distributed in the circumferential direction with respect to the rotating axis of the rotating shaft 12. For example, the distribution may be a substantially uniformly spaced radial and/or circumferential distribution, or a regular but non-uniformly spaced radial and/or circumferential distribution, etc.

Beneficially, the cutting orifices 30 are arranged on the cutting disc 21 in both the radial direction and distributed in the circumferential direction with respect to the axis of the rotating shaft 12. In some embodiments, the cutting disc 21 includes multiple cutting groups 36, each cutting group 36 including at least two cutting orifices 30, as shown in FIG. 3. The multiple cutting groups 36 are arranged on the cutting disc 21 in the radial direction and distributed in the circumferential direction with respect to the rotation axis of the rotating shaft 12. The multiple cutting groups 36 may also be disposed in different orientations, so that the multiple cutting orifices 30 are distributed on the cutting surface 211 in a staggered layout. This way, the cutting orifices 30 can cover substantially the entire cutting range of the rotating cutter 22, making the cutting operation more efficient.

In some embodiments, the cutting protrusion 38 of the cutting orifice 30 may be a ring shaped structure, and include an inner cutting edge 32 on the inner side of the ring shaped structure and an outer cutting edge 33 on the outer side of the ring shaped structure, as shown in FIGS. 4*a* and 4*b*. It should be understood that the ring shape here refers to a shape formed by a band that surrounds the hole; they are not required to be round, and may alternatively have a shape that is triangular, square, rectangular, oval, regular or non-regular polygonal, etc.

By providing the dual inner and outer cutting edges, the cutting orifices 30 achieve multiple cutting actions in their interactions with the rotating cutter 22. Since the floating matters in the liquid, under the suction pressure of the pump, have to enter the pump body 11 via the hole regions 31 of the cutting orifices 30, they will be cut into sufficiently small particles under the multiple cutting actions, so that they can enter and exit the pump body smoothly and unimpeded.

In the embodiment shown in FIG. 4*a*, the ring shaped structure of the cutting protrusion 38 has at least one gap 37 in the ring, which can help the small particles produced by the cutting action enter the pump body. In the embodiment shown in FIG. 4*b*, the ring shaped structure of the cutting protrusion 38 is a closed ring without any gaps.

FIG. 4*a* shows an exemplary cutting group 36*a*, where the two cutting orifices 30 are connected together by at least one cutting tip 34 (one is shown). The cutting tip is a protrusion from the cutting surface 211 ending at the same height level as the protrusions 38 of the cutting orifices 30. The edges of the cutting tip 34 form a pointed cutting tip edge 34*a* which is connected to the cutting edges of the cutting orifices. For example, in the case where the ring shaped structures 38 have gaps 37, as shown in FIG. 4*a*, the cutting tip edges 34*a* pass through the gap to be connected to the inner cutting edges 32 of the cutting orifices 30. Beneficially, the cutting tip edges 34*a* and their tip generally face against the forward moving direction of the rotating cutter 22 (refer to FIG. 3). As shown in FIG. 4*a*, in some embodiments, the cutting disc 21 may further include cutting blocks 35 distributed between the cutting orifices 30. The cutting blocks 35 are protrusions from the cutting surface 211 ending at the same height level as the protrusions 38 of the cutting orifices 30. Each cutting block 35 has cutting edges 35*a*, where the cutting edges 35*a* and their pointed tip generally face against the forward moving direction of the rotating cutter 22. The cutting tips 34 and cutting blocks 35 provide further cutting actions for cutting the floating matters. Although they are shown as having triangular shapes, other shapes may also be used.

In the exemplary cutting group 36*b* shown in FIG. 4*b*, the ring shaped structures of the cutting protrusion 38 are closed rings. In this case, the cutting tip edge 34*b* of the cutting tip 34 are connected to the outer cutting edges 33 of the cutting orifices 30.

In some embodiments, as shown in FIG. 3, the cutting surface 211 of the cutting disc 21 further includes multiple diversion ribs 40, which may be connected to or separated from the cutting orifices 30. The diversion ribs 40 are protrusions from the cutting surface 211, and are distributed in the circumferential direction around the rotation axis of the rotating shaft 12. Similar to the distribution of the cutting orifices 30, the multiple diversion ribs 40 may be arranged in the radial direction of the cutting disc 21. The diversion ribs 40 may have curved or linear shapes extending in a radial direction. For a curved shape, the tangential direction of the curve may be substantially parallel to the moving direction of the cutting edge 222 of the rotating cutter 22.

Using the cutting orifices, including individual cutting orifices, grouped cutting orifices, connected cutting orifices, or cutting orifices in combination with diversion ribs, embodiments of the present invention solve the low cutting efficiency problem and pump entrance blockage problem of conventional technologies. More specifically, referring to FIGS. 1-3, when the grinding pump 10 is operation, the impeller 13 of the pump body 11 is driven by the rotating shaft 12 to rotate; the liquid such as wastewater enters the pump body 11 from the cutting orifices 30 of the cutting system 20 under the suction pressure, and enters the pump inlet 14. When the floating matters in the liquid pass in the vicinity of the cutting orifices 30, the rotating cutter 22, which rotates with the rotating shaft 12, performs cutting operations with the cutting disc 21. Thus, larger particles in the liquid are cut and shredded into smaller particles, so that the smaller particles can enter the pump body 11 from the cutting orifices 30 along with the liquid. Further, the impeller 13 drives the wastewater to exit the outlet 15. The cutting system 20 improves the cutting effectiveness and the pumping effectiveness.

It should be understood that the embodiments shown in the drawings only illustrate the preferred shapes, sizes and spatial arrangements of the various components of the grinding pump and its cutting system. These illustrations do not limit the scope of the invention; other shapes, sizes and spatial arrangements may be used without departing from the spirit of the invention.

It will be apparent to those skilled in the art that various modification and variations can be made in the embodiments of the present invention without departing from the spirit or scope of the invention. Thus, it is intended that the present invention cover modifications and variations that come within the scope of the appended claims and their equivalents.

What is claimed is:

1. A cutting system for a grinding pump, the cutting system comprising:

a cutting disc configured to be attached to the grinding pump near an inlet of the grinding pump, wherein the cutting disc includes a cutting surface, and the cutting surface has a plurality of cutting orifices; and a rotating cutter configured to be attached to the grinding pump via a rotating shaft of the grinding pump, wherein the rotating cutter includes at least two cutting blades, each cutting blade having a cutting edge on a forward-facing side in a direction of rotation of the rotating cutter, the rotating cutter being located on an upstream side of the cutting disc, wherein each cutting edge is configured to cooperate with the plurality of cutting orifices to perform a cutting action when the rotating cutter rotates;

wherein each cutting orifice has a hole region extending from the cutting surface through the cutting disc to form a feeding orifice, and has a cutting protrusion that protrudes from the cutting surface, the cutting protrusion surrounding the hole region, wherein the plurality of cutting orifices define at least one recessed area of the cutting surface between at least two of the cutting orifices, and wherein the cutting protrusion of each cutting orifice is a ring-shaped structure that includes an inner cutting edge on an inner side of the ring-shaped structure and an outer cutting edge on an outer side of the ring-shaped structure.

2. The cutting system of claim 1, wherein the cutting orifices are arranged on the cutting disc in a radial direction and distributed in a circumferential direction with respect to a rotation axis of the rotating shaft.

3. The cutting system of claim 1, wherein the ring-shaped structure of the cutting protrusion of each cutting orifice either has at least one gap, or is a closed ring without any gaps.

4. The cutting system of claim 1, wherein the cutting disc includes a plurality of cutting groups, each cutting group including at least two of the plurality of cutting orifices, and wherein the plurality of cutting groups are arranged on the cutting disc in a radial direction and distributed in a circumferential direction with respect to a rotation axis of the rotating shaft.

5. The cutting system of claim 4, wherein at least one cutting group of the plurality of cutting groups further includes at least one cutting tip configured to connect the at least two cutting orifices of the cutting group, the cutting tip having a cutting tip edge connected to cutting edges of the cutting orifices.

6. The cutting system of claim 5, wherein the cutting tip edge faces against the direction of rotation of the rotating cutter.

7. The cutting system of claim 1, wherein the cutting disc further includes a plurality of cutting blocks distributed between the cutting orifices, wherein each cutting block has a cutting edge facing against the direction of rotation of the rotating cutter.

8. The cutting system of claim 1, wherein the cutting surface further includes a plurality of diversion ribs which are either connected to or separated from the cutting orifices, wherein the diversion ribs are distributed in a circumferential direction around a rotation axis of the rotating shaft.

9. The cutting system of claim 8, wherein each diversion rib has a linear shape and extends in a radial direction of the cutting disc.

10. The cutting system of claim 1, wherein the at least one recessed area is located on at least one plane.

11. A grinding pump comprising the cutting system of claim 1, the grinding pump further comprising a pump body having the inlet and an outlet, wherein the rotating shaft is disposed within the pump body, wherein the cutting disc is fixedly connected to the pump body and covers the inlet, wherein the rotating cutter is fixedly connected to the rotating shaft and is driven by the rotating shaft, whereby the cutting edges of the rotating cutter cooperate with the plurality of cutting orifices to perform cutting actions when the rotating cutter rotates.

12. The cutting system of claim 8, wherein each diversion rib has a curved shape, and a tangential direction of the curved shape is parallel to the direction of rotation of the rotating cutter.

* * * * *